US009425502B2

(12) United States Patent
Chen et al.

(10) Patent No.: US 9,425,502 B2
(45) Date of Patent: Aug. 23, 2016

(54) WIRELESS MODULE WITH INTEGRATED ANTENNA BY USING RIGID-FLEX BOARD

(71) Applicants: Universal Scientific Industrial (Shanghai) Co., Ltd, Shanghai (CN); Universal Global Scientific Industrial Co., Ltd, Caotun Township, Nanotu County (TW)

(72) Inventors: Hsin-Hong Chen, Taichung (TW); Ruei-Kun Shih, Caotun Township, Nantou County (TW); Echan Liu, Caotun Township, Nantou County (TW)

(73) Assignees: UNIVERSAL SCIENTIFIC INDUSTRIAL (SHANGHAI) CO., LTD, Shanghai (CN); UNIVERSAL GLOBAL SCIENTIFIC INDUSTRIAL CO., LTD, Caotun Township, Nantou County (TW)

( * ) Notice: Subject to any disclaimer, the term of this patent is extended or adjusted under 35 U.S.C. 154(b) by 87 days.

(21) Appl. No.: 14/191,992

(22) Filed: Feb. 27, 2014

(65) Prior Publication Data

US 2015/0116156 A1 Apr. 30, 2015

(30) Foreign Application Priority Data

Oct. 31, 2013 (TW) ..... 102139614 A

(51) Int. Cl.

*H01Q 1/38* (2006.01)
*H01Q 1/22* (2006.01)
*H01Q 23/00* (2006.01)

(52) U.S. Cl.

CPC ..... *H01Q 1/38* (2013.01); *H01Q 1/2208* (2013.01); *H01Q 23/00* (2013.01)

(58) Field of Classification Search

USPC ..... 343/700 MS, 702
See application file for complete search history.

(56) References Cited

U.S. PATENT DOCUMENTS

| | | | | |
|---|---|---|---|---|
| 5,914,690 | A * | 6/1999 | Lehtola | H01Q 1/243 343/700 MS |
| 6,157,344 | A * | 12/2000 | Bateman | G06F 1/1616 343/700 MS |
| 6,421,013 | B1 * | 7/2002 | Chung | G06K 19/07749 235/441 |
| 6,867,736 | B2 * | 3/2005 | Faraone | H01Q 1/38 343/700 MS |
| 8,344,955 | B2 | 1/2013 | Niemi | |
| 2008/0111226 | A1 * | 5/2008 | White | H01L 23/66 257/686 |
| 2008/0316109 | A1 * | 12/2008 | Savolainen | H01Q 1/2283 343/700 MS |

* cited by examiner

*Primary Examiner* — Hoang V Nguyen
*Assistant Examiner* — Hai Tran
(74) *Attorney, Agent, or Firm* — Muncy, Geissler, Olds & Lowe, P.C.

(57) ABSTRACT

A wireless module includes a flex substrate, an antenna integrated in the flex substrate and electrically connected to a signal layer and a ground layer of the flex substrate, a first rigid substrate stacked on one side of the flex substrate remote from the antenna, and a communication unit mounted on the first rigid substrate and electrically connected to the signal layer. Thus, the flex substrate and the first rigid substrate are laminated into a Rigid-Flex board. Further, the signal layer and the ground layer are continuously arranged in the same flex substrate. It will be helpful in decreasing the uncertainty and loss of RF signal transmission path, reducing component costs, facilitating optimization of the antenna and reducing the module size.

9 Claims, 2 Drawing Sheets

WIRELESS MODULE WITH INTEGRATED ANTENNA BY USING RIGID-FLEX BOARD

BACKGROUND OF THE INVENTION

1. Field of the Invention

The present invention relates to a built-in wireless module for handheld electronic device and more particularly, to a wireless module with integrated antenna by using rigid-flex board having the characteristics of small size, low loss, low cost, and design and optimization facilitation.

2. Description of the Related Art

With new advances in technology, all kinds of handheld electronic products are used widely and developed with the tread toward deeper integration and smaller handheld sizes. In consequence, built-in electronic communication module is inevitably developed towards the same trend.

Conventional wireless module designs commonly have the communication IC and the antenna be mounted in one single printed circuit board. This design has the drawback of large size, not facilitating locational optimization of the antenna. Therefore, this design is not suitable for use in a small-sized electronic product. In order to eliminate this problem, another prior art design of wireless module was created. This prior art design uses a RF connector and a cable to connect separated communication IC and antenna, facilitating optimization of the antenna in the internal space of the electronic product. However, according to this design, the RF connector and the cable must use special materials and design techniques to reduce high-frequency loss, resulting in significant increase in component costs. A pin connector can be used to substitute for the aforesaid RF connector and cable for high-frequency loss reduction, however the impedance matching problem in signal transmission greatly increase the degree of design difficulty.

In view of the above-mentioned problems, U.S. Pat. No. 8,344,955 discloses a wireless module, entitled "Integrated antenna with e-flex technology". This design enables a communication IC and an antenna to be respectively mounted in a rigid PC board and a flex PC board, wherein the flex PC board has at least one part thereof joined to one end of the rigid PC board to constitute a rigid-flex board. However, because the power layer and the ground layer are interruptedly mounted in the rigid PC board and a flex PC board, this design not only increases circuit complexity, but also may introduce unnecessary noises. Therefore, there is still room for improvement.

SUMMARY OF THE INVENTION

The present invention has been accomplished under the circumstances in view. It is the main object of the present invention to provide a wireless module with integrated antenna by using rigid-flex board, which integrates an antenna and a communication IC into a rigid-flex board to reduce loss and costs, providing reliable signal quality.

To achieve this and other objects of the present invention, a wireless module with integrated antenna by using rigid-flex board of the invention comprises a flex substrate comprising opposing first surface and second surface and a signal layer and a ground layer, an antenna integrated in one side of the flex substrate and comprising a radiator and a feed-in segment and a grounding segment extended from the radiator and respectively electrically connected to the signal layer and ground layer of the flex substrate, a first rigid substrate stacked on the first surface of the flex substrate at an opposite side remote from the antenna, and a communication unit integrated in the first rigid substrate and electrically connected to the signal layer.

Thus, the signal layer and the ground layer are continuously arranged on one same flex substrate. This arrangement is helpful to decrease the uncertainty and loss of RE signal transmission path, to improve signal transmission performance and quality, and to reduce component costs. Further, the characteristic of flexibility of the flex substrate facilitates optimization of the antenna. Further, integrating the flex substrate and the first rigid substrate into a rigid-flex board is helpful in reducing the size of the wireless module and facilitating the installation.

Further, the antenna can be, but not limited to, planar inverted F antenna, near field communication antenna, monopole antenna or dipole antenna.

Further, the optimal design of the invention is to package the communication unit on the rigid substrate using the technique of SiP (System In Package, facilitating application.

Other and further benefits, advantages and features of the present invention will be understood by reference to the following specification in conjunction with the accompanying drawings, in which like reference characters denote like elements of structure.

DETAILED DESCRIPTION OF THE INVENTION

Figure 1:
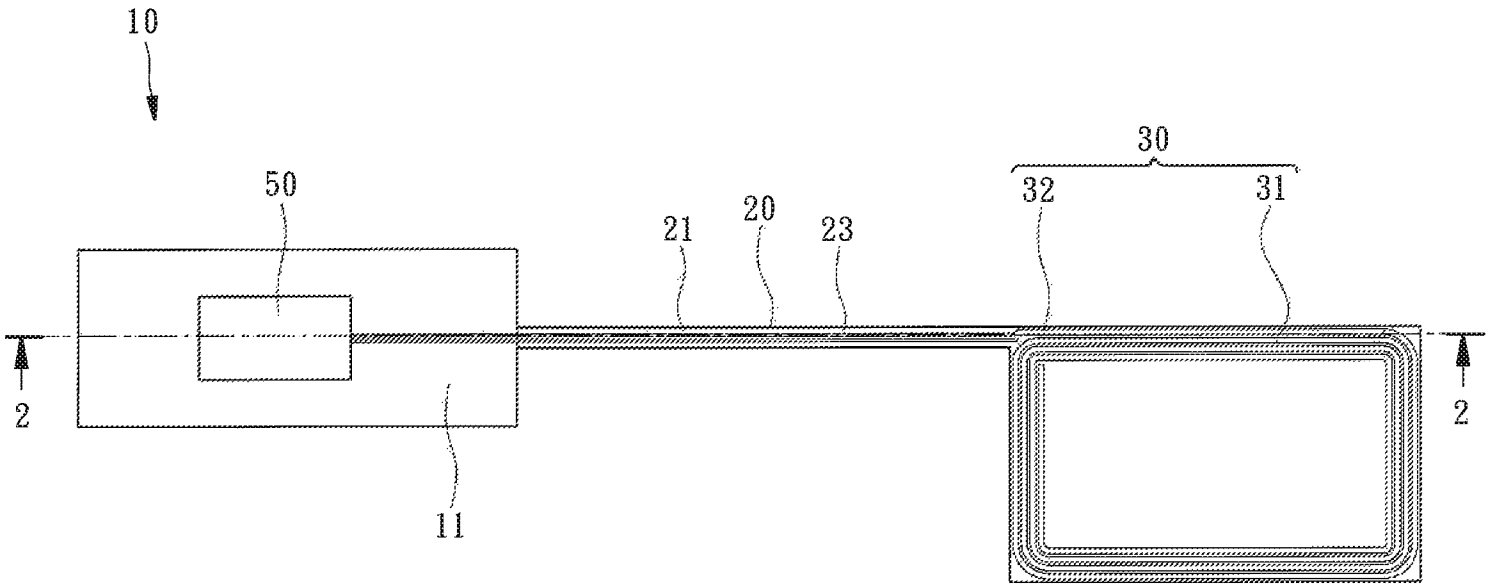
FIG. 1 is a schematic drawing illustrating the structural architecture of a wireless module in accordance with the first embodiment of the present invention.
Figure 2:
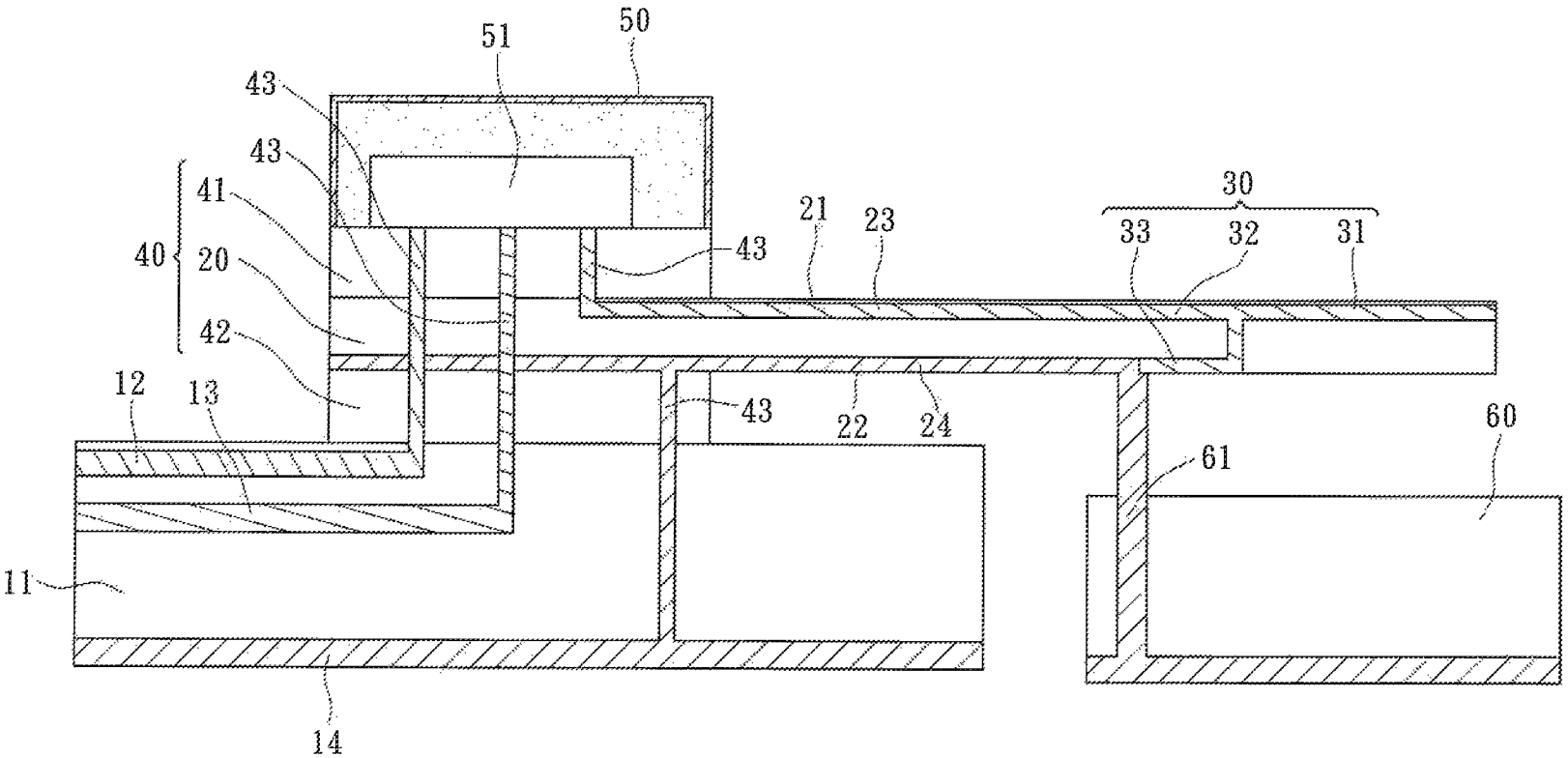
FIG. 2 is a sectional view taken along line 2-2 of FIG. 1.

Referring to FIGS. 1 and 2, a wireless module 10 in accordance with the present invention is shown. The wireless module 10 comprises a flex substrate 20, an antenna 30 integrated in one side of the flex substrate 20, two rigid substrates 41 and 42 stacked on an opposite side of the flex substrate 20 remote from the antenna 30, and a communication unit 50 integrated in the rigid substrate 41. The structural features of the aforesaid components are outlined hereinafter.

The flex substrate 20 comprises a first surface 21, a second surface 22 opposite to the first surface 21, an electrically conducting signal layer 23 integrated in the first surface 21, and an electrically conducting ground layer 24 integrated in the second surface 22.

The antenna 30 is integrated in the first surface 21 of the flex substrate 20. In this embodiment, the antenna 20 is a NFC (Near Field Communication) antenna, comprising a radiator 31, and a feed-in segment 32 and a grounding segment 33 extended from the radiator 31 and respectively connected to the signal layer 23 and the ground layer 24. To a person having ordinary skill in the art, changing the antenna into a planar inverted-F antenna, monopole antenna or dipole antenna would have been obvious.

The rigid substrates 41 and 42 are respectively stacked on the first surface 21 and second surface 22 of the flex substrate 20 at one side remote from the antenna 30 using a lamination process, and thus the rigid substrates 41 and 42 and the flex substrate 20 are combined to constitute a rigid-flex board 40. This rigid-flex board 40 is connected to a main board through aboard to board connector or any other interface means. The rigid-flex board 40 comprises a plurality of conductive vias 43 respectively electrically connected to the signal layer 23, the ground layer 24 and the power trace 12, signal trace 13 and ground trace 14 of the main board 11.

The communication unit 50 comprises at least one communication IC 51 packaged on the rigid substrate 41 of the rigid-flex board 40 using a semiconductor packaging technique, such as SiP (System in Package), MCP (Multi-Chip Package) or PoP (Package on Package) and electrically connected to the aforesaid conductive vias 43, joining the antenna 30 to perform wireless communication functions.

In addition to the aforesaid components, this embodiment further comprises a grounding component 60 having a conducting structure 61 electrically connected to the connection between the ground layer 24 of the flex substrate 20 and the grounding segment 33 of the antenna 30.

With the foregoing structure, the wireless module 10 of the invention uses the flex substrate 20 and the rigid substrates 41 and 42 to constitute a rigid-flex board 40 that is then integrated with the antenna 30 and the communication unit 50. Further, the antenna 30 is directly connected to the signal layer 23 and ground layer 24 of the flex substrate 20, and then connected to the communication unit 50 through the conductive vias 43. Therefore, the high-frequency signal transmission path is quite simple, and proper measures can be taken in advance in response to the problem of impedance matching. Further, this design does not need to face the high-frequency connectors and cables uncertainty, and can significantly reduce the difficulty of development and component costs. Further, with modular design to reduce the size of the wireless module 10, the wireless module 10 can easily be installed in the main board 11 of a mobile electronic device, enabling the allocation of the antenna 30 to be optimized using the characteristic of high flexibility of the flex substrate 20, so as to achieve the purpose of the present invention.

It is to be noted that the number of the rigid substrates of the rigid-flex board can be reduced to one, i.e., the rigid substrate 42 at the second surface 22 is adapted for use as a reinforcing material to reinforce the mechanical strength. By means of changing the geometric configuration of the rigid substrate 41 can overcome this problem.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A wireless module with integrated antenna by using rigid-flex board, comprising:

a flex substrate comprising opposing first surface and second surface, a signal layer and a ground layer;

an antenna integrated in one side of said flex substrate, said antenna comprising a radiator and a feed-in segment and a grounding segment extended from said radiator and respectively electrically connected to said signal layer and said ground layer;

a first rigid substrate directly stacked on at least a part of said first surface of said flex substrate at an opposite side remote from said antenna; and a communication unit integrated in said first rigid substrate and electrically connected to said signal layer;

wherein said antenna and said signal layer are located on said first surface.

2. The wireless module with integrated antenna by using rigid-flex board as claimed in claim 1, wherein said ground layer is located on said second surface.

3. The wireless module with integrated antenna by using rigid-flex board as claimed in claim 1, wherein said communication unit comprises at least one communication IC.

4. The wireless module with integrated antenna by using rigid-flex board as claimed in claim 3, wherein each said communication IC is packaged on said first rigid substrate using the semiconductor packaging technique of SiP (System in Package).

5. The wireless module with integrated antenna by using rigid-flex board as claimed in claim 3, wherein each said communication IC is packaged on said first rigid substrate using the semiconductor packaging technique of MCP (Multi-Chip Package).

6. The wireless module with integrated antenna by using rigid-flex board as claimed in claim 3, wherein each said communication IC is packaged on said first rigid substrate using the semiconductor packaging technique of PoP (Package on Package).

7. The wireless module with integrated antenna by using rigid-flex board as claimed in claim 3, further comprising a second rigid substrate stacked on said second surface.

8. The wireless module with integrated antenna by using rigid-flex board as claimed in claim 1, wherein said antenna is selected from the group of planar inverted-F antenna, near-field communication antenna, monopole antenna and dipole antenna.

9. The wireless module with integrated antenna by using rigid-flex board as claimed in claim 1, further comprising a grounding component, said grounding component comprising a conducting structure connected to the connection between said ground layer of said flex substrate and said grounding segment of said antenna.

* * * * *